US008960967B2

(12) United States Patent
Harwood

(10) Patent No.: US 8,960,967 B2
(45) Date of Patent: Feb. 24, 2015

(54) HOUSING FOR INTELLIGENT LIGHTS

(76) Inventor: Ronald P. Harwood, West Bloomfield, MI (US)

( * ) Notice: Subject to any disclaimer, the term of this patent is extended or adjusted under 35 U.S.C. 154(b) by 176 days.

(21) Appl. No.: 13/565,887

(22) Filed: Aug. 3, 2012

(65) Prior Publication Data

US 2012/0294014 A1 Nov. 22, 2012

Related U.S. Application Data

(63) Continuation-in-part of application No. 11/154,153, filed on Jun. 16, 2005, now abandoned.

(60) Provisional application No. 60/623,115, filed on Oct. 28, 2004.

(51) Int. Cl.

| | |
|---|---|
| ***F21V 7/00*** | (2006.01) |
| ***F21S 8/08*** | (2006.01) |
| ***F21S 2/00*** | (2006.01) |
| ***F21V 21/15*** | (2006.01) |
| ***F21V 23/04*** | (2006.01) |
| *F21S 10/02* | (2006.01) |
| *F21V 14/02* | (2006.01) |
| *F21V 14/08* | (2006.01) |
| *F21V 21/30* | (2006.01) |
| *F21V 33/00* | (2006.01) |
| *F21W 131/103* | (2006.01) |
| *F21W 131/107* | (2006.01) |
| *F21Y 101/02* | (2006.01) |

(52) U.S. Cl.

CPC .. *F21S 8/088* (2013.01); *F21S 2/00* (2013.01); *F21V 21/15* (2013.01); *F21V 23/0435* (2013.01); *F21S 10/02* (2013.01); *F21V 14/02* (2013.01); *F21V 14/08* (2013.01); *F21V 21/30* (2013.01); *F21V 33/0052* (2013.01); *F21W 2131/103* (2013.01); *F21W 2131/107* (2013.01); *F21Y 2101/02* (2013.01)

USPC ..... 362/307; 362/246; 362/299; 362/305

(58) Field of Classification Search

USPC ..... 362/35, 84, 153, 153.1, 170, 184, 199, 362/200, 208, 231, 235, 236, 240, 244, 245, 362/247, 249.01, 249.02, 276, 298, 300, 362/303, 305, 307, 309, 311.01, 311.02, 362/312, 329, 347, 362, 470, 477, 478, 479, 362/485, 487, 493, 545, 800; 340/471–473, 340/815.45, 815.73, 815.75, 908, 908.1, 340/981, 984

See application file for complete search history.

(56) References Cited

U.S. PATENT DOCUMENTS

| | | | | |
|---|---|---|---|---|
| 1,384,659 | A * | 7/1921 | Benard | 362/309 |
| 1,399,973 | A | 12/1921 | Limpert | |
| 3,705,303 | A | 12/1972 | Willis, Jr. et al. | |
| 3,845,351 | A | 10/1974 | Ballmoos et al. | |

(Continued)

*Primary Examiner* — Hargobind S Sawhney

(74) *Attorney, Agent, or Firm* — Brooks Kushman P.C.

(57) ABSTRACT

An intelligent light fixture is shown which allows for hands-free or automatic control of any desired combination of the color of the lighting beam, the focus position of the lighting beam, the movement of the lighting beam and projection of patterns created by the lighting beam. The intelligent light fixture is configured and mounted in such a way that all of the above can be accomplished from a single mounting position on top, or of within, the structure that holds the intelligent light fixture. The intelligent light fixture may be contained within a housing and said housing maybe mounted to a light pole.

24 Claims, 15 Drawing Sheets

(56) References Cited

U.S. PATENT DOCUMENTS

| | | | | | |
|---|---|---|---|---|---|
| 4,216,377 | A | * | 8/1980 | Hasegawa et al. | 250/574 |
| 4,242,614 | A | | 12/1980 | Vatis et al. | |
| 4,302,069 | A | | 11/1981 | Niemi | |
| 4,392,187 | A | | 7/1983 | Bornhorst | |
| 4,712,167 | A | | 12/1987 | Gordin et al. | |
| 4,797,795 | A | | 1/1989 | Callahan | |
| 4,931,916 | A | | 6/1990 | Callahan | |
| 4,947,302 | A | | 8/1990 | Callahan | |
| 5,209,560 | A | | 5/1993 | Taylor et al. | |
| 5,335,157 | A | * | 8/1994 | Lyons | 362/297 |
| 5,414,606 | A | | 5/1995 | Weingartner | |
| 5,608,290 | A | * | 3/1997 | Hutchisson et al. | 315/200 A |
| 5,865,533 | A | | 2/1999 | Liu | |
| 5,929,788 | A | * | 7/1999 | Vukosic | 340/908.1 |
| 6,035,266 | A | | 3/2000 | Williams et al. | |
| 6,086,218 | A | * | 7/2000 | Robertson | 362/157 |
| 6,183,100 | B1 | * | 2/2001 | Suckow et al. | 362/35 |
| 6,364,506 | B1 | * | 4/2002 | Gallo | 362/245 |
| 6,464,373 | B1 | * | 10/2002 | Petrick | 362/235 |
| 6,543,911 | B1 | * | 4/2003 | Rizkin et al. | 362/307 |
| 6,565,233 | B1 | | 5/2003 | Richardson | |
| 6,623,140 | B2 | * | 9/2003 | Watterson et al. | 362/184 |
| 6,626,557 | B1 | * | 9/2003 | Taylor | 362/235 |
| 6,776,508 | B2 | | 8/2004 | Bucher et al. | |
| 6,932,496 | B2 | * | 8/2005 | Rizkin et al. | 362/299 |
| 7,021,801 | B2 | * | 4/2006 | Mohacsi | 362/477 |
| 7,111,958 | B2 | * | 9/2006 | Coman | 362/153.1 |
| 7,168,839 | B2 | * | 1/2007 | Chinniah et al. | 362/555 |
| 7,246,917 | B2 | * | 7/2007 | Rhoads et al. | 362/241 |
| 2002/0159262 | A1 | | 10/2002 | Romano et al. | |

* cited by examiner

SYSTEM CONTROL DIAGRAM

HOUSING FOR INTELLIGENT LIGHTS

CROSS-REFERENCE TO RELATED APPLICATIONS

This application is a continuation-in-part of U.S. application Ser. No. 11/154,153 filed Jun. 16, 2005, which, in turn, claims the benefit of U.S. provisional Application No. 60/623,115 filed Oct. 28, 2004, the disclosures of which are incorporated in their entirety by reference herein.

TECHNICAL FIELD

The present invention relates to illumination. More particularly, the present invention relates to the use of luminaries for street, building, and pedestrian illumination which allow for hands free or automatic control of the color of the lighting beam, and/or the focus position of the lighting, and/or the movement of the lighting beam, and/or projection of patterns created by the lighting beam, all configured and mounted in such a way that all of the above features can be accomplished from a single mounting position on top of, or within the structure, that holds the luminaire or luminaries. Such luminaries can be defined to be "intelligent lights". Most particularly the present invention relates to a housing for such intelligent lights, a lighting fixture or pole to hold such a housing, and a lighting system using intelligent lights.

BACKGROUND

Street lighting has been used heretofore exclusively to illuminate buildings and vehicular and pedestrian traffic. In this regard, beginning with oil and gas lighting, arc lighting, and then mercury vapor, metal halide, and sodium lighting sources, the attempt and the goal has been to provide one single source of illumination that provides light for safety, and illuminates the landscape below the street light. Street lighting is traditionally mounted on top of poles and the luminaire focused downward. Further, in all cases except for the manual addition of different light sources or filters, the color or color temperature of the light source is fixed. The color temperature of light sources is expressed in "degrees Kelvin". The light sources, due to their manufactured characteristics, produce a single "color temperature" in the visible spectrum.

As outdoor activities have become more common, there has arisen the need to increasingly illuminate buildings, in addition to streets, to change the color of the lights for use in "light shows" and the like, for projection of patterns in the light beam, and for movement of the lighting beam as desired. While lights that can change color are known in the art, and moveable lights are known in the art, as remotely controlled lights each of these requires one or more separate fixtures for use outdoors, and do not utilize the luminaries readily available in streetlights. Thus, those skilled in the art continue to search for a solution on how to provide luminaries for street and building illumination that allow for "hands free" or automatic control of any desired combination of the following: the color of the lighting beam, the focus position of the lighting, the movement of the lighting beam, and projections of patterns created by the lighting beam, all configured and mounted in such a way that all of the above features can be accomplished from a single mounting position on top or within the structure that holds the luminaire or luminaries.

SUMMARY

The present invention solves the aforementioned problems in the art by providing a housing for an intelligent light comprising a frame member of a generally parallelepiped shape, a yoke mounted at the top of said frame member for rotation about a first axis, a luminaire mounted to said yoke for rotation about a second axis which is at a fixed angle with respect to said first axis, a pyramidal conical, or other shaped reflector mounted to the bottom of said frame member below said luminaire, and a second luminaire mounted inside said pyramidal or conical reflector and pointing downwardly.

An intelligent lighting pole or fixture may be provided by providing a structural member to which the housing for the intelligent light may be mounted. An intelligent lighting system would utilize at least one of the intelligent lighting poles or fixtures, and would, in addition, provide speakers controlled by an audio control device to provide audio signals to the speaker, and a lighting control device electrically connected to said luminaries to change the color, intensity, focus, direction or patterns projected by the luminaire. The term "pole" as used in the present application should be understood to mean pole, bollard, truss or the like.

Also provided is a light fixture which is suitable for converting existing light fixtures into intelligent light fixtures.

Thus, one of the objects of the present invention is to create luminaries for street, building, and pedestrian illumination.

Another object of the present invention is to create a luminaire of the foregoing nature that allows for hands free or automatic control of the color of the lighting beam.

A still further object of the present invention is to provide luminaire of the foregoing nature that allows hands free or automatic control of the focus position of the lighting.

A still further object of the present invention is to provide luminaire of the foregoing nature which allows for hands free or automatic control of the movement of the lighting beam.

A still further object of the present invention is to create a luminaire of the foregoing nature which provides for hands free or automatic control of projection of patterns created by the luminaire.

Another object of the present invention is to provide luminaire of the foregoing nature so that all of the above objects can be accomplished from a single mounting position on top or within the structure that hold the luminaire or luminaries.

Still another object of the present invention is to provide an intelligent light pole or fixture to which a housing for intelligent lights of the foregoing nature may be mounted.

Still another object of the present invention is to provide an intelligent lighting system utilizing one or more intelligent light poles.

Further objects and advantages of the present invention will become apparent to those skilled in the art when considered by those skilled in the art in view of the accompanying drawings in which like reference numerals indicate corresponding parts in the several view.

Figure 1:
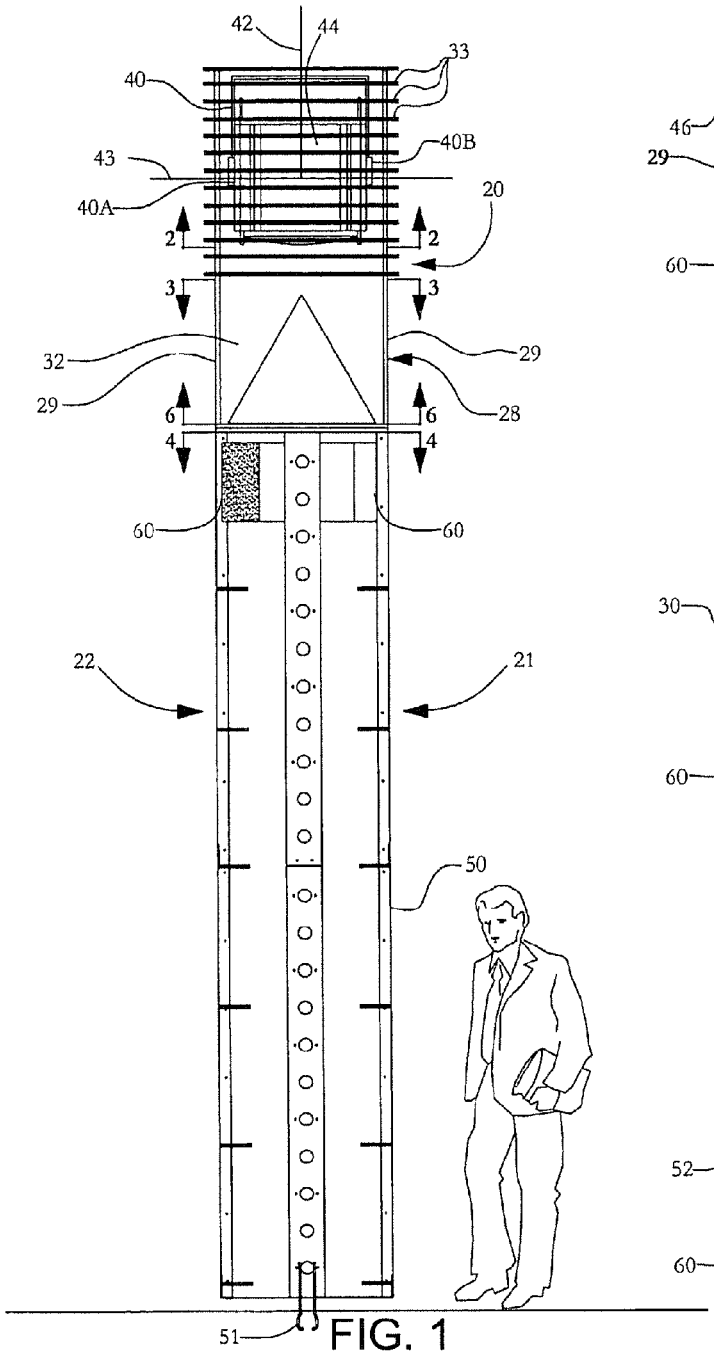
FIG. 1 is an elevational view of a construction embodying the present invention.
Figure 2:
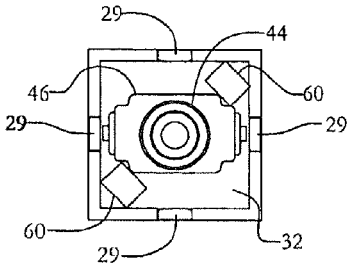
FIG. 2 is a sectional view, taken in the direction of the arrows, along the section line 2-2 of FIG. 1.
Figure 3:
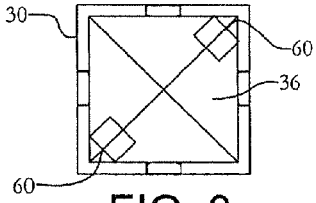
FIG. 3 is a sectional view, taken in the direction of the arrows, along the section line 3-3 of FIG. 1.
Figure 4:
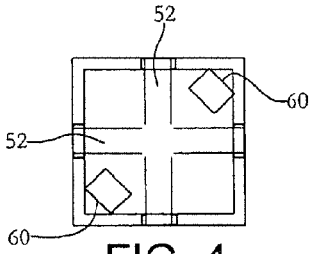
FIG. 4 is a sectional view, taken in the direction of the arrows, along the section line 4-4 of FIG. 1.

It is to be understood that the present invention is not limited to the details of construction and arrangement of parts illustrated in the accompanying drawings, since the invention is capable of being practiced or carried out in various ways within the scope of the claims. Also, it is to be understood, that the terminology and phraseology used herein is for the purpose of description, and not of limitation.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The specific devices and processes illustrated in the attached drawings, and described in the following specification, are simply exemplary embodiments of the inventive concepts defined in the appended claims. Hence, specific dimensions and/or other physical characteristics relating to the embodiments disclosed herein are not to be considered as limiting, unless expressly stated otherwise.

Referring now to FIGS. 1-4 there is shown a housing for an intelligent light, generally designated by the numeral 20, mounted on top of a light pole or other structural member, generally designated by the numeral 21. The combination of a housing for an intelligent light 20, when mounted to a light pole 21, may be referred to as an intelligent lighting fixture, generally designated by the numeral 22. A plurality of intelligent lighting fixtures 22 may form an intelligent lighting system 24 (FIG. 8) when electrically connected to an audio control device 25 and a lighting control device 26.

Intelligent light housing 20 is constructed using a frame 28, generally of a parallelepiped shape. Frame 28 is preferably, but not necessarily, of a square cross-section. Frame 28 includes four corner posts 29 which are all securely joined together by a base member 30, and a top member 31 to enclose a generally rectangular area 32. This will allow operation of the luminaire in a manner to be described below. For aesthetic purposes, the lighting designer may attach decorative grills 33 to the frame or frame member 28.

To aid in the mounting of the yoke 40, cross-braces 34 (FIG. 5) form part of the top of the frame or frame member 28. Mounted interiorly of the frame 28 is a pyramidal reflector 36 having an apex 37 and base 38. The base 38 of the pyramidal reflector 36 is preferably coextensive with the base member 30 of the frame 28, and blocks any light from passing downwardly through the pyramidal reflector 36. The pyramidal reflector is preferably solid, and white in color, although, depending on the application, the reflector could be transparent or translucent, and/or be of any desired color. It may also have openings therein, if desired. The reflector may be segmented or prismatic in nature, and be made of glass or acrylic or other desired material. Depending on the application, the pyramidal reflector 36 may be replaced by a conical reflector, or a reflector of another desired shape. Such interchange or replacement of the reflector is well within the scope of the present invention.

Mounted to the top 30 of frame member 28 is a yoke 40 mounted for rotation about a first axis 42, which is preferably, but not necessarily, the same as the vertical axis of the intelligent light housing 20. It can be appreciated that other axes could be used if desired, as long as the yoke 40 could rotate. The yoke is preferably motorized, as is well known in the art, so that it can be remotely controlled, as will be described hereinafter.

Mounted to the yoke 40 for rotation about a second axis 43 is a first luminaire 44. The second axis 43 is preferably, but not necessarily, perpendicular to the first axis 42, and extends through the arms (40A, 40B) of the yoke 40. Preferably, the first luminaire is also motorized for rotation, so it may be remotely controlled, as hereinafter described.

With the yoke 40 rotating about a first axis 42, and the first luminaire 44 rotating about a second axis 43, the first luminaire 44 is able to be pointed in any desired direction, such as straight down, when used for street lighting or pedestrian pathway lighting, or sideways or substantially upwards when used for lighting buildings, or in any direction necessary for entertainment purposes, such as when used for color light shows or projecting images.

The first luminaire 44 may be mounted in a waterproof housing 46, which may be such as the Tornado Model 2000 housing manufactured by Tempest Lighting, Inc. of Farmingdale, N.Y. It is preferred that the luminaire itself is a color changing light of approximately 150 to 600 watts, such as the Exterior 600 or Exterior 600 color changing fixture distributed by Martin of Denmark.

Figure 5:
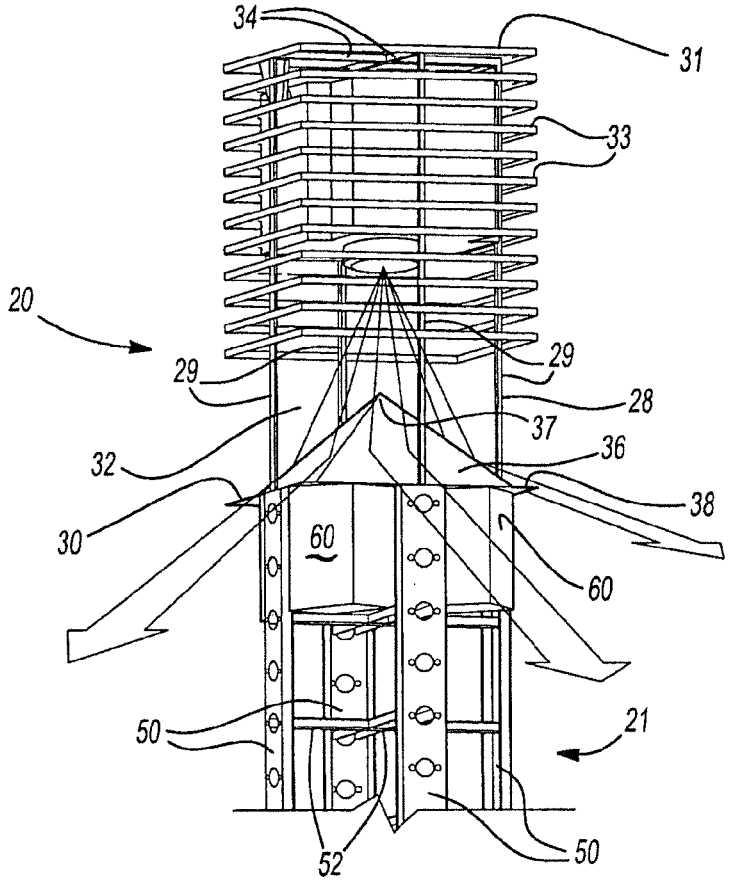
FIG. 5 is a partial perspective view of the construction shown in FIG. 1.
Figure 6:
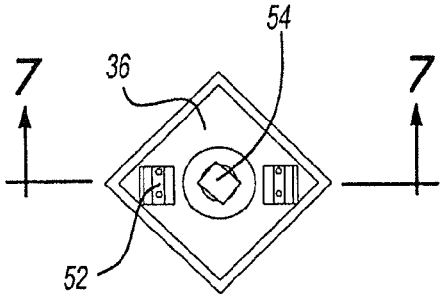
FIG. 6 is a sectional view, taken in the direction of the arrows, along the section line 6-6 of FIG. 1.
Figure 7:
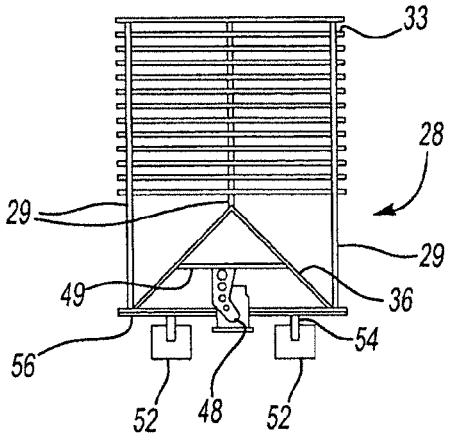
FIG. 7 is a sectional view, taken in the direction of the arrows, along the section line 7-7 of FIG. 6.

As illustrated in FIGS. 1 and 5, when first luminaire 44 is pointed straight down, the first axis 42, the longitudinal axis of the first luminaire 44, and the apex 37 of the pyramidal reflector 36, are all preferably in alignment, and the light from the first luminaire will hit the top of the pyramidal reflector 36 and be directed as shown by the arrows in FIG. 5. In this position, light is mainly supplied to the area below the intelligent light housing 20.

Because in the preferred embodiment, the pyramidal reflector is solid, there will be an area directly below the housing 20, which is unlit. In applications where this may be a problem, a second luminaire 48 is mounted interiorly of the pyramidal reflector 36 on a bracket 49. Such second luminaire may be such as an FLC131 fixture, manufactured by WE-EF of Germany, or a PAR lamp fixture. The second luminaire will preferably be pointed vertically downwardly to illuminate the area directly below the intelligent light housing 20.

Figure 8:
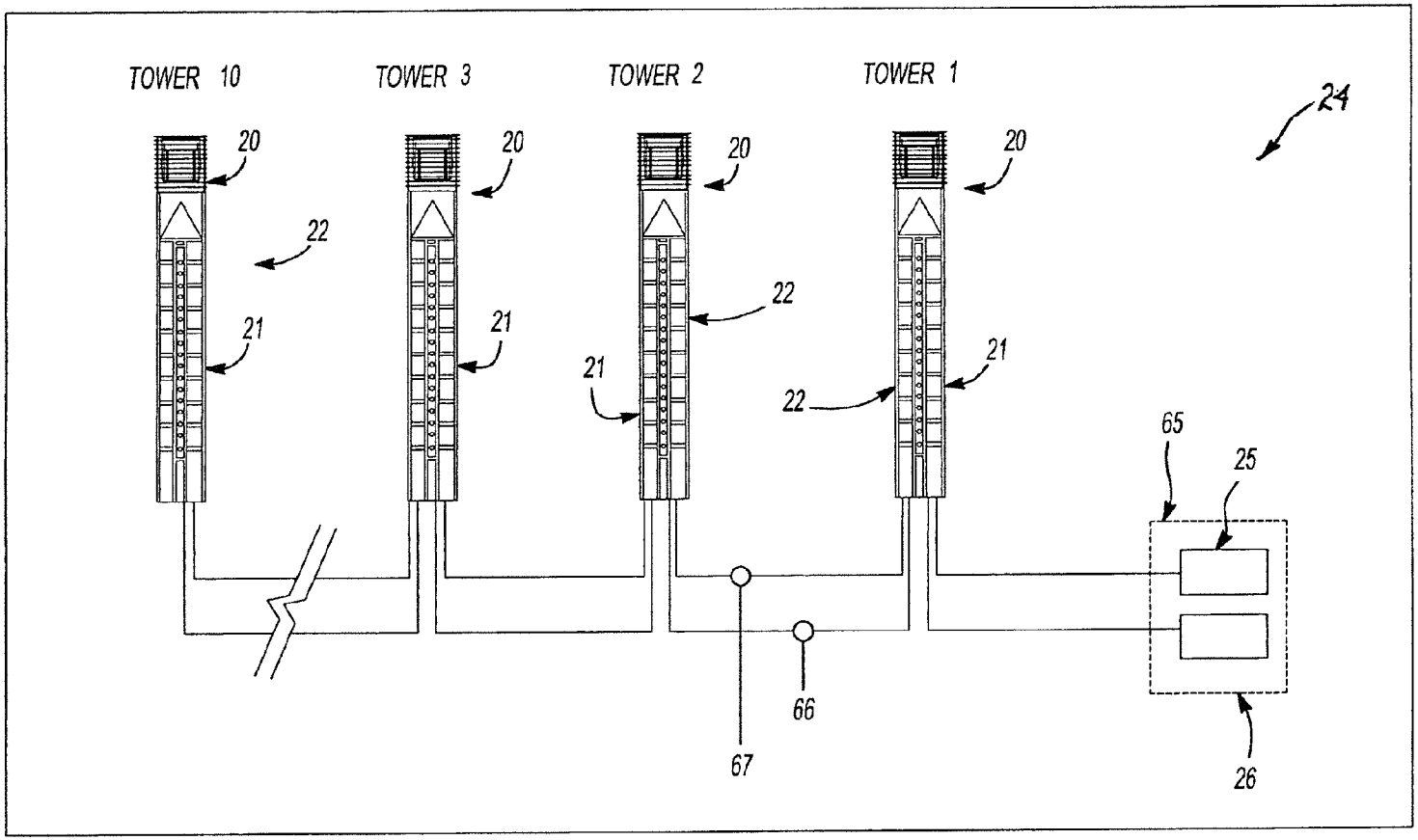
FIG. 8 is a diagrammatic view of an intelligent lighting system embodying the present invention.

With reference to FIGS. 1, 5 and 8, the intelligent light housing 20 may be mounted to the top of a suitable light pole or other structural member 21 to form at least part of an intelligent light fixture 22. The light pole may be complimentary in shape to the intelligent light housing 20, i.e., both may be of a square cross-section, or the light pole or other structural member 21 may be of a different desired shape. In the preferred embodiment, light pole 21 comprises four side members 50, each having suitable anchors 51 for anchoring, or otherwise mounting the light pole 21 to the ground, another structure, or other desired mounting point. It can be understood that the type of anchors 51 will vary depending on what the light pole 21 is being mounted to.

Side members 50 have cross-members 52 attached thereto for strengthening the light pole 21. Suitable brackets 54, which may be of any type well known in the art, are used to mount top plate 56 to the top of the side members 50, and provide for the mounting of the intelligent light housing to the light pole 21 to form at least part of the intelligent light fixture 22.

If desired, one or more audio or visual devices, such as speakers 60, may be mounted to the light pole or other structural member 21, or enclosed within the fixture housing 46, and also form part of the intelligent light fixture 22.

One or more intelligent light fixtures 22 may be connected together to form an intelligent lighting system 24, such as shown in FIG. 8. To take full advantage of the intelligent lighting system 24, a means to control the luminaries (44, 48) and audio and visual devices (such as speakers 60) used in the system will be provided. The control means 65 will comprise an audio control device 25 and a lighting control device 26, together with suitable lighting control cable 66 and audio control cable 67 to connect these devices to the intelligent light fixtures 22 used in the system 24. If video devices are used (not shown) suitable video control devices and cables may be added to system 24.

The intelligent light system described thus far provides an adjustable pattern of light distribution from a remote location digitally, provides for color mixing if desired, and enables movement of a primary light source in the x, y, and z coordinates but requires new light housings and/or light poles to accomplish this.

It is also desirable to provide an adjustable pattern of light distribution from a remote location digitally, provide for color mixing if desired, and enable movement of a primary light source in the x, y and z coordinates in existing housings of any style, whether new, or already installed.

Figure 9B:
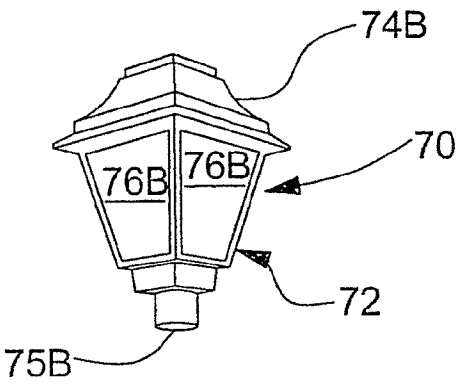
(PRIOR ART) FIGURE 9B
FIG. 9B is a perspective view of a second, known, historic style existing light fixture which may be converted to an intelligent light by use of the present invention.
Figure 9A:
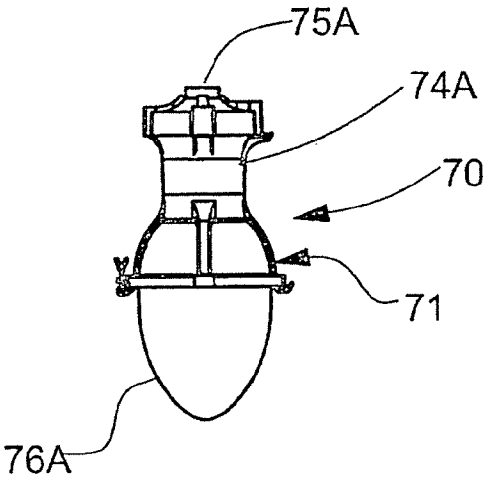
(PRIOR ART) FIGURE 9A
FIG. 9A is an elevational view of a first, known, historic style existing light fixture which may be converted to an intelligent light by use of the present invention.

Referring to FIGS. 9A and 9B, there are shown two historic style fixtures, generally designated by the numeral 70. Illustrated are a historic style fixture generally indicated by the numeral 71, and a coach light style fixture, generally indicated by the numeral 72. Each has a housing (74A, 74B), an attachment mechanism (75A, 75B) for mounting the fixture to poles or building structures, and at least one lens or diffuser or refractor (76A, 76B). It was desired to try and convert these existing housings 74 to color changing light fixtures which could be used in the manner described above. Since such known light fixtures would have to perform all the functions of existing normal street lights, as well as color changing fixtures. It was decided to start with a compact, and well known color changing light fixture, and install it in existing housing designs to see if it would work. While many color changing light fixtures are available, it was found that the Martin 200 Washlight by Martin Architectural of Arhus, Denmark was the most preferred fixture to start with.

Figure 10:
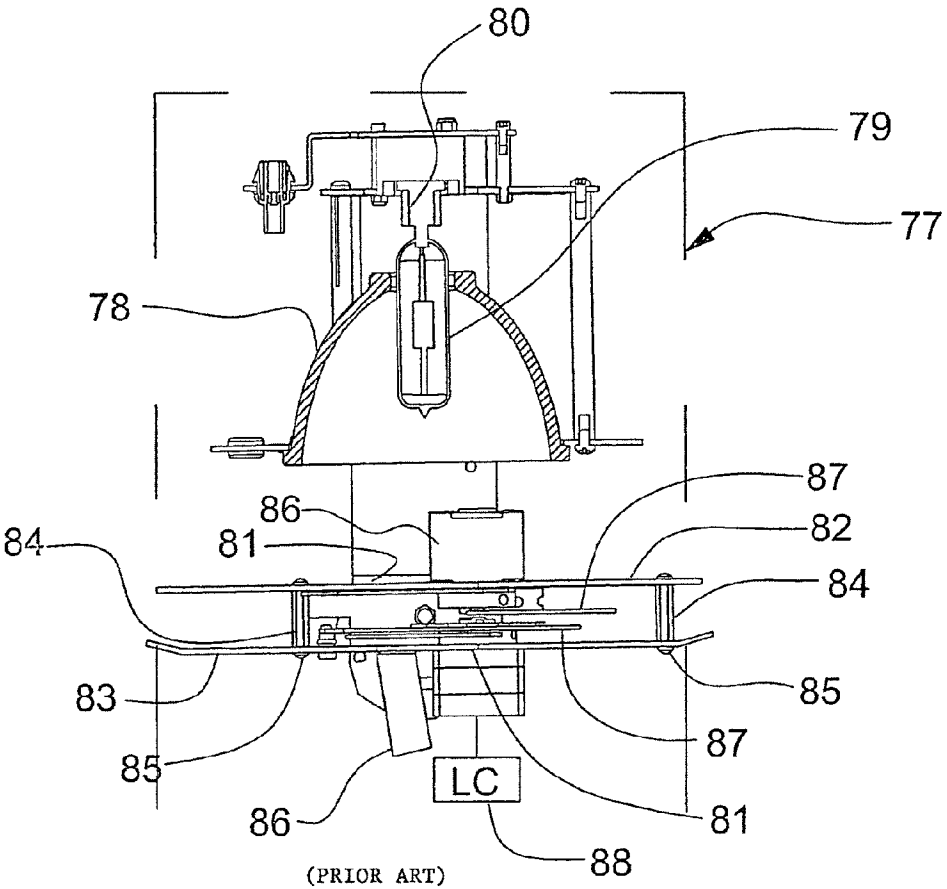
(PRIOR ART) FIGURE 10
FIG. 10 is an elevational view, partially cut-away, of an existing light fixture or light source which is utilized in some embodiments of the present invention.

Referring to FIG. 10, the Martin 200 contains inside its housing 77 a primary reflector 78 having a discharge lamp 79 mounted at least partially within the primary reflector so the light from the discharge lamp will be focused downwardly by the primary reflector. The discharge lamp 79 may be part of a lighting module 80, which is removable for relamping. Downstream of the primary reflector, and axially aligned therewith, is an aperture 81 in axial alignment with the primary reflector 78. The aperture 81 is provided in a first plate 82. First plate 82 is held in a spaced apart relationship from second plate 83 by spacers 84 and fastening means 85, such as screws, rivets, pop rivets and the like. A plurality of stepper motors 86 move an equal plurality of color filters or mechanical dimmers 87. A logic controller 88 is connected to each stepper motor 86 to control the movement of the mechanical filters or dimmers 87 on demand. For purposes of clarity, some parts of the Martin 200 have been omitted.

Figure 13:
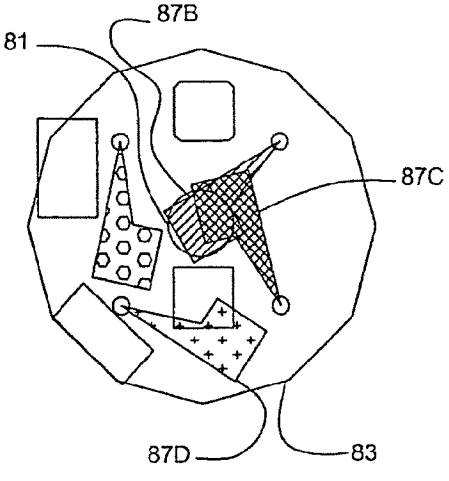
(PRIOR ART) FIGURE 13
FIG. 13 is a view similar in large part to FIG. 11, showing the light fixture of FIG. 10 in its "color mixing" position.
Figure 12:
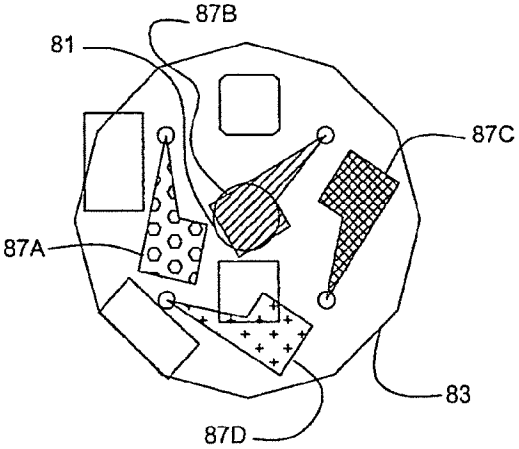
(PRIOR ART) FIGURE 12
FIG. 12 is a view similar in large part to FIG. 11, showing the light fixture of FIG. 10 in its "closed" or "one color added or subtracted from white" position.
Figure 11:
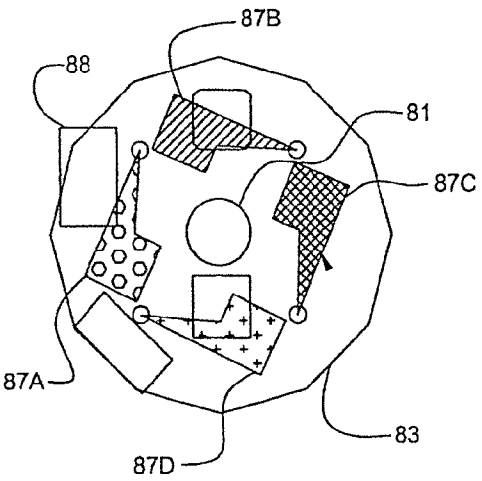
(PRIOR ART) FIGURE 11
FIG. 11 is a bottom view of the light fixture shown in FIG. 10 in its "open", or "white light" position.

Referring now to FIGS. 11-13, it is shown how the Martin 200 can be dimmed or produce various colored lights. In the illustration shown, there are four color filters or mechanical dimmers which for ease of understanding are labeled 87A-D. Each of the color filters or mechanical dimmers may be glass color filters, or dimmers, or colored gel color filters. In the illustration shown in FIG. 11, none of the color filters or dimmers 87A-D is covering the aperture 81, and this is referred to as the open position of the fixture.

In FIG. 12, color dimmer or filter 87B is covering the aperture 81 which will make the white light coming through the aperture assume a color the same as the color filter or dimmer 87B. This position of the fixture is referred to as the closed position for one color added or subtracted from white.

Referring now to FIG. 13, it can be seen that color filter 87B is completely covering the aperture 81, while color filter 87C is partially covering the aperture, as well as a portion of color filter 87B. This is referred to as the color mixing position.

Those skilled in the art will appreciate that many other color positions of the color filters or dimmers 87A-D are possible to produce the desired effect.

Figure 14:
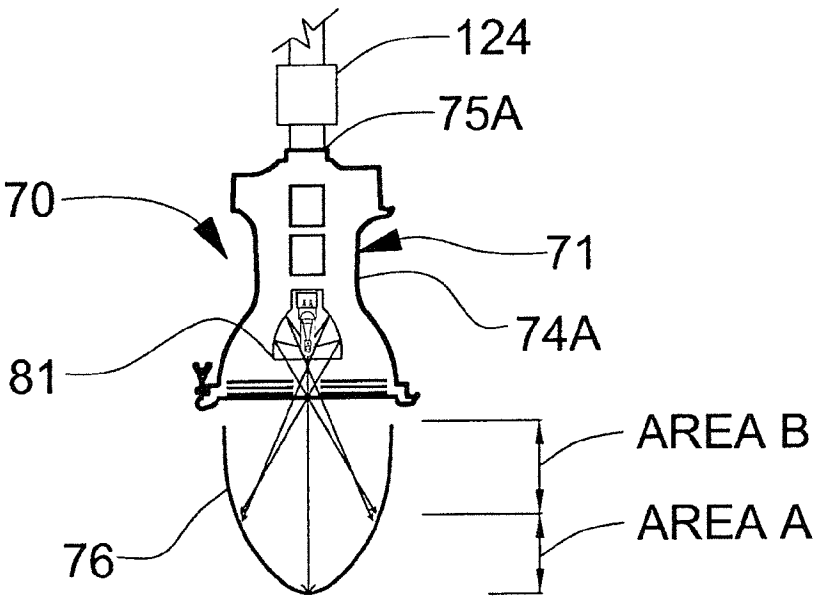
FIG. 14 is a diagrammatic view showing an existing historic style lighting fixture having the light source of FIG. 10 installed therein.

Referring now to FIG. 14, an unexpected problem was encountered when placing the construction of FIG. 10 inside the housing of FIG. 9A. Whether the fixture 70 had the dimmers or color filters in their open, closed, or color mixing position, because of the construction of the Martin 200, which is designed to be a wall wash fixture, the light beam projected from the discharge lamp 79 primarily goes straight ahead and only lights area A of lens 76 leaving area B unlit or of a muddy appearance, which is undesirable in a color changing fixture due to the poor aesthetics. It is desired to have the whole lens 76A of a desired color.

Figure 15:
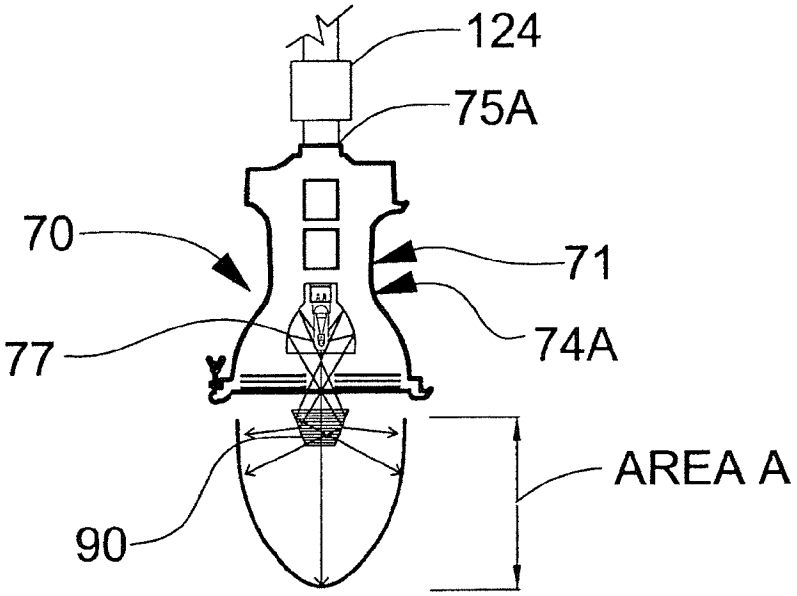
FIG. 15 is a diagrammatic view, similar in large part to FIG. 14, but having a secondary diffuser installed therein in accordance with one embodiment of the present invention.

Referring now to FIG. 15, it was discovered by placing a secondary diffuser 90 a short distance from the aperture 81, the light would diffuse and fill the whole lens 76. The secondary diffuser 90 may consist of a series of prismatic or angled incisions or "cuts" into any clear material such as glass, and acrylic or other polymers. Such "cuts" re-direct light beams toward the existing housings lenses 76 for final distribution.

While this was satisfactory for the historic style fixture 71, it proved unsatisfactory for many other style fixtures, including the coach light style fixture 72 shown in FIG. 9B. There was no place to mount the mechanism from the Martin 200 color changing light fixture, and no way to satisfactorily diffuse it. Thus, additional invention was needed in order to provide a mechanism which would be satisfactory for all fixtures.

With reference to both FIG. 14 and FIG. 15, there is shown a way to mount a speaker assembly 124 to an existing light fixture.

Figure 16:
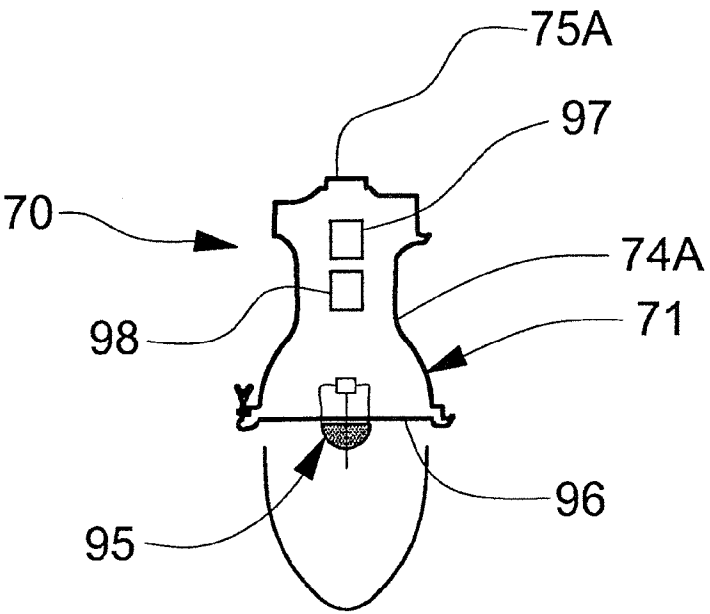
FIG. 16 is a diagrammatic, elevational view, showing a further embodiment of the present invention.

Referring to FIG. 16, there is shown an embodiment of the present invention, which, with only small modification, is usable in all types of existing light fixtures, whether already installed, or to be installed. In this modification of the invention, shown again with the historic style fixture 71 for ease of illustration, the color changing light fixture 77 is no longer used, and an LED source, generally indicated by the numeral 95, is installed on a reflector 96, which closes the end of the historic housing 74A. The reflector 96 may be flat, convex, concave, or other shape, depending on the application.

Additionally, installed in the historic style light fixture housing 74 is a transformer/power supply 97, which is electrically connected to logic supply 98. Logic supply 98 is in turn connected to LED source 95. For ease of illustration, the wiring has been omitted in FIG. 16, as it is well within the skill of those in the art to wire together the transformer power supply 97, the logic supply 98 and the LED source 95. Depending on the transformer or power supply 97 which is used, these may be either self-contained, or connected to an outside source of power (not shown), which is typical for a streetlight.

Figure 17:
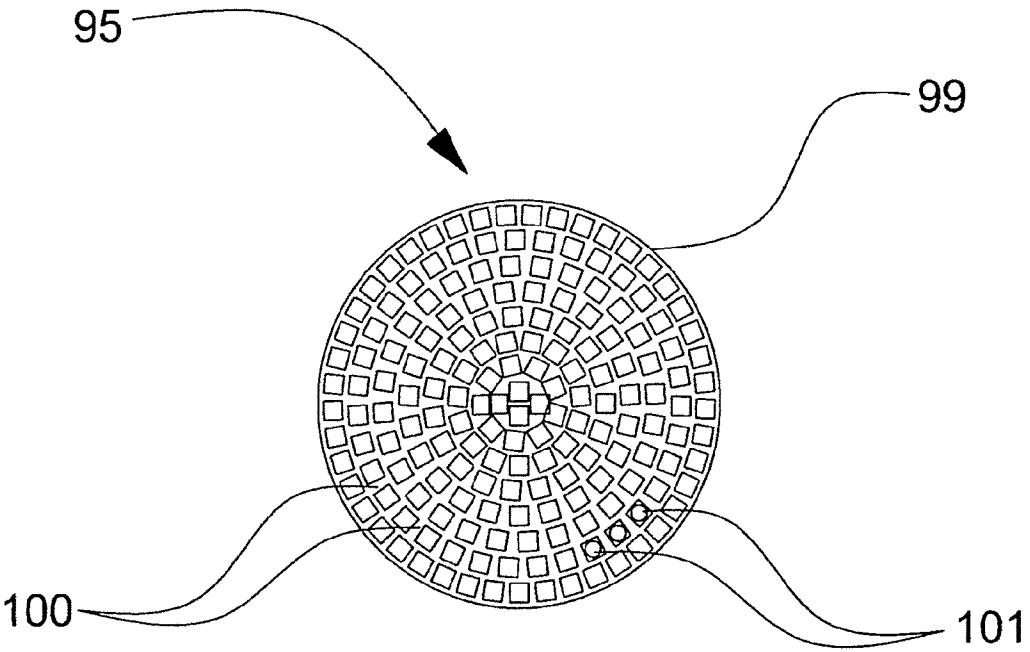
FIG. 17 shows a plan view of a flexible plastic or metal "fabric" which may be used in any of the constructions shown in FIG. 16 and FIGS. 18-20.

Referring now to FIG. 17, the LED source 95 may comprise a fabric 99 having apertures 100 into which LEDs 101 can be mounted, and may consist of any suitable material in which LEDs can be mounted, such as plastic or metal. The quantity, shape, and size of the openings or apertures 100 may also vary depending upon the application.

Figure 18:
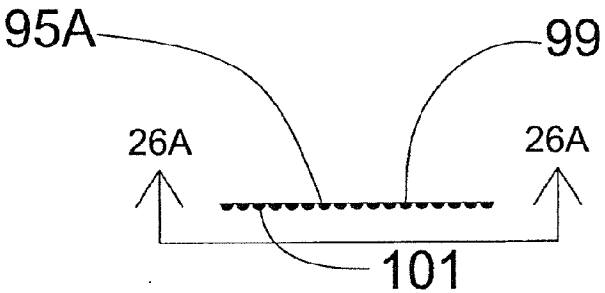
FIG. 18 shows a planer LED source.
Figure 19:
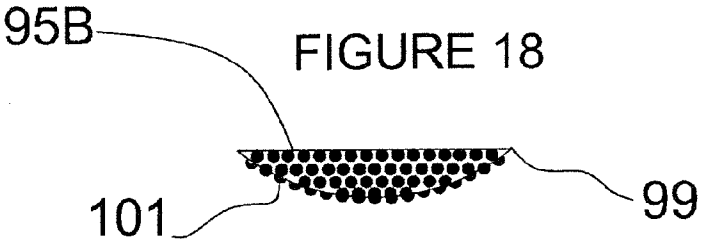
FIG. 19 shows a curved LED source.
Figure 20:
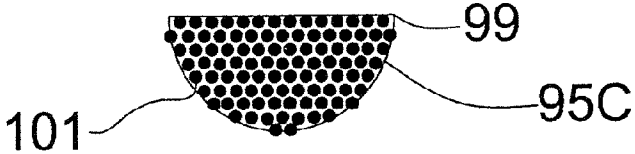
FIG. 20 shows a spherical LED source.

Referring now to FIGS. 18-20, the great versatility of the present invention may be understood, as these figures illustrate only a few of the different shapes the LED source may be. In FIG. 18, there is shown a flat LED source 95A. In FIG. 19, there is shown a curvilinear shaped LED source 95B, while 95C shows a hemispherical LED source. Each of the LED sources comprises at least a fabric portion 99 having at least one LED 101 mounted therein. It can be seen that LED source 95 can be of any shape that it is practical to form, mold, shape or otherwise fabricate the fabric 99 into.

Figure 21:
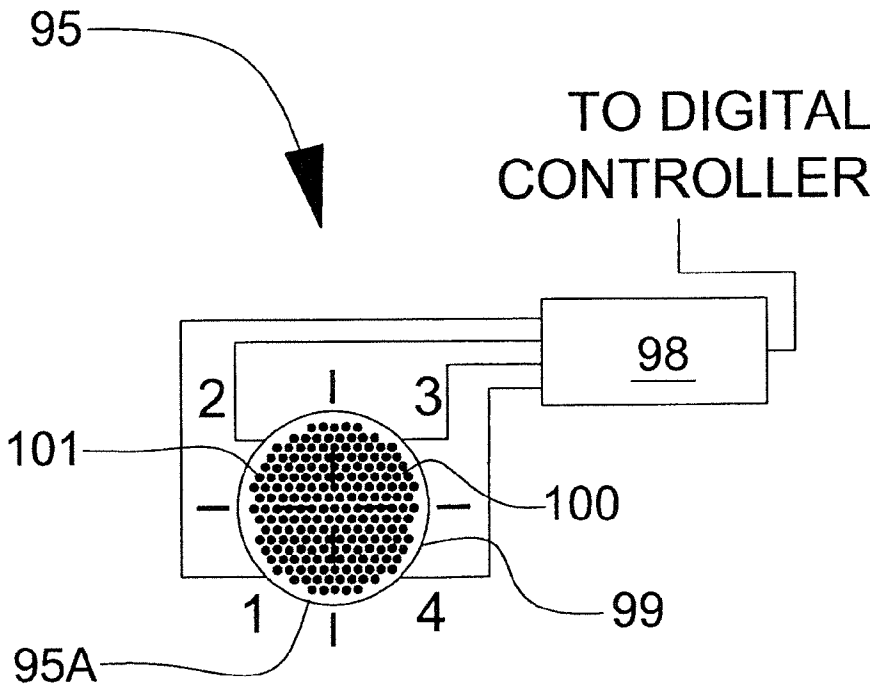
FIG. 21 shows how the LED source of FIGS. 16-20 may be connected to a digital controller.

Referring to FIG. 21, one of many possible connection methods is shown by which various effects and light distribution may be obtained by the present invention. There is shown an LED source 95, which in the illustration is the flat LED source 95A. As before, the flat LED source 95A has a fabric 99 with a plurality of openings or apertures 100 into which LEDs 101 are placed. The flat LED source 95A has been arbitrarily divided into four quadrants numbered 1-4 for wiring purposes. Each quadrant can be wired for individual control of each LED 101, or LED clusters of red/blue/green LEDs, or LEDs that have a variable color. Each quadrant 1-4 and therefore, the LEDs 101 in that quadrant, are connected to logic supply 98, which in turn is connected to a digital controller (not shown). In the wiring configuration illustrated, 1, 2, 3 or 4 quadrants can be on, or all quadrants can be on together. Each quadrant may show the same or different colors as desired. Provisions for electrically or electronically dimming the LED's when desired may also be provided. LED dimmers may be of the waveform dimming, resistance dimming, or digital dimming type. The circuitry for such LED dimmers would typically be found in, and/or be a function of the logic controller 98. It could also be provided in a remote location.

Figure 22:
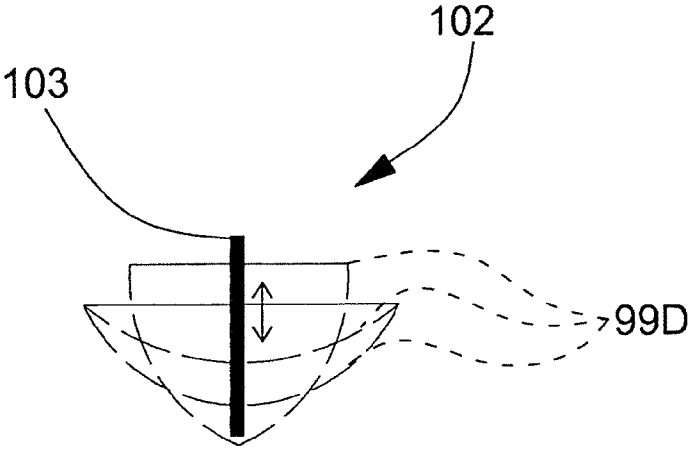
FIG. 22 shows how the flexible fabric may be modified in shape by an adjustment means to produce a universal LED source.

Referring to FIG. 22, a universal LED source 102 is shown whose shape and thus, light distribution pattern, can be varied as desired by having an adjustment means of a type well known in the art, such as an adjustable rod 103, operate on the fabric 99D in which the LEDs 109 are mounted. In this embodiment of the invention, it is desired that the fabric 99D be of a very flexible nature so that the cross-section of the fabric may be changed as desired to provide section varied shapes and forms of the flexible fabric 99D which may be combined with various cut-out arrays for varied light distribution.

Figure 23:
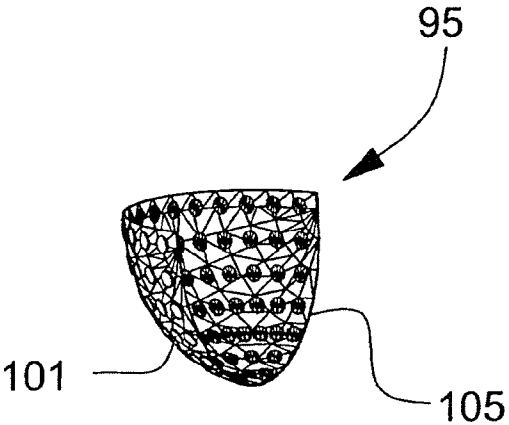
FIG. 23 shows a modification of the construction shown in FIG. 20.

FIG. 23 shows a LED source 95 having a molded "fabric" 105 into which LEDs 101 are inserted. In the embodiment illustrated, the molded fabric 105 is in the shape of a quadrant or one-quarter of a sphere. It is well within the scope of the present invention that the molded fabric 105 be of any desired shape.

Figures 24A, 24B, 25A, 25B, 25C:
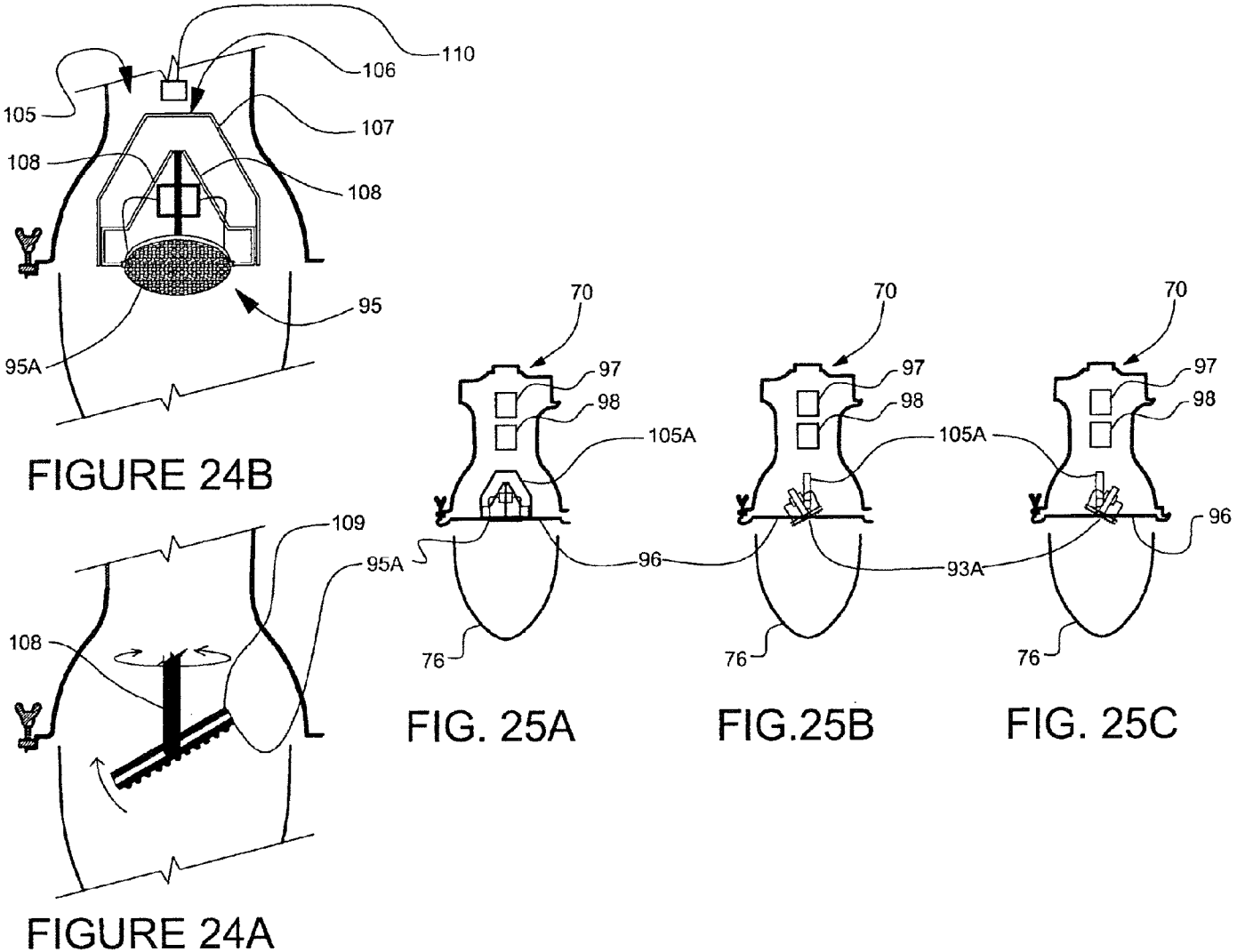
FIG. 24A shows how an LED source may be mounted on a gimble for rotation about the X, Y and Z axes.
FIG. 24B shows the construction of FIG. 24A rotated 90.degree.
FIG. 25A shows the construction of FIG. 24A mounted inside an historic style light fixture with the LED source pointed straight down.
FIG. 25B is a view similar in part to FIG. 25A, but showing the LED source pointed to the right.
FIG. 25C is a view similar in part to FIG. 25A, but showing the LED source pointed to the left.

Referring now to FIGS. 24A and 24B, there is shown how a flat LED source 95A can be mounted to a gimbal assembly 105 of the type which is well known in the lighting art. Generally, such a gimbal assembly will have a fork 106 having a pair of arm portions 108 connected to shaft or connecting portion 107. Shaft or connecting portion 107 may be connected to a motor 110 for rotation. The motor 110 may be mounted to the ceiling (not shown) of a room, or in any other desired location. A power supply and a control means (not shown) will enable the lighting operator to cause the shaft or connecting portion 107 to rotate when desired. Rotatably mounted between the vertical arm portions 108 of the fork 106 is a support 109 to which the flat LED source 95A can be mounted. In the illustrated embodiment, the flat LED source 95A is shown, but it is well within the scope of the present invention to mount an LED source 95 of any desired shape to the support 109. It can be seen that by virtue of the construction shown in FIGS. 24A and 24B, an LED source 95 of any desired shape can be rotated to any desired position by rotation in the X, Y or Z direction (coordinates) through electrical and/or digital control.

Referring now to FIGS. 25A-25C, there is shown an embodiment of the present invention utilizing the gimbaled flat LED source 95A illustrated in FIGS. 24A and 24B. In this embodiment of the invention, a gimbal assembly 105A is shown mounted to the flat reflector 96 of a historic style light fixture 71, which may be such as illustrated in FIG. 16, although is well within the scope of the present invention that any style light fixture, whether installed, or to be installed, could be used with any gimbaled LED source 95.

In FIG. 25A the flat LED source 95A is shown pointing straight down. An opening is provided in the reflector 96 through which the light shines. With the gimbal assembly 105A in the position shown, it can be understood that the flat LED source 95A could be rotated up to 90.degree. to shine directly at the viewer, or be rotated up to 90.degree. to shine directly away from the viewer. In most applications, 90 degrees of rotation is sufficient, but a greater amount of rotation can be provided, if desired.

With reference to FIGS. 25B and 25C, it can be seen that the gimbal assembly 105A has been rotated 90.degree. about its vertical axis, and the flat LED source 95A can be rotated clockwise, or counter-clockwise, to point the light source 95A to the left, or right respectively, with regard to the viewer.

Figure 26C:
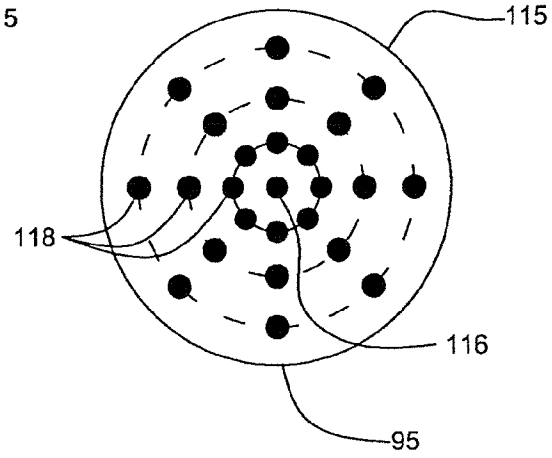
FIG. 26C is a view, similar in part to FIG. 26A and showing a central LED and three concentric rows of LEDs lit.
Figure 26B:
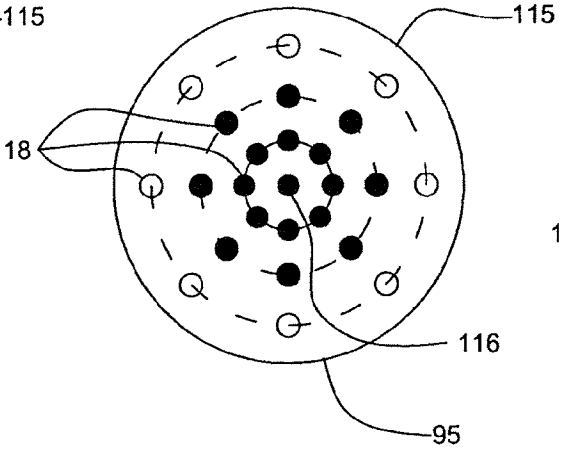
FIG. 26B is a view, similar in part to FIG. 26A and showing a central LED and two concentric rows of LEDs lit.
Figure 26A:
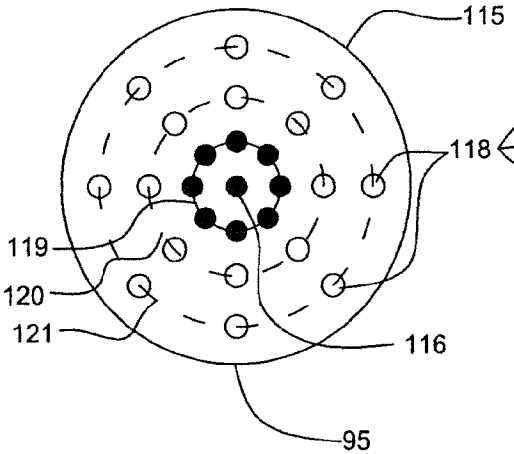
FIG. 26A is a view, taken in the direction of the arrows, along the view line 26A-26A of FIG. 18, and showing a central LED and one of three concentric rows of LEDs being lit.

Referring to FIGS. 26A-26C, the great versatility that can be achieved with the LED source 95 can be understood. In this embodiment of the invention, there is illustrated a modified LED source 115 having a central LED 116, surrounded by plurality of LEDs 118 arranged in a first concentric circle 119, a second concentric circle 120, and a third concentric circle 121. Any pattern of these LEDs (116, 118) can be illuminated by the use or the appropriate control means well known in the art, such as the logic supply 98 and digital controller shown in FIG. 21.

In FIG. 26A, only the central LED 116 and the first concentric circle 119 of LEDs 118 are illuminated, as shown by the darkened LEDs. In FIG. 26B, it can be seen that the central LED 116, and the first concentric circle 119 and second concentric circle 120 of LEDs 118 are illuminated. In FIG. 26C, the central LED 116, the first concentric circle 119, the second concentric circle 120 and the third concentric circle 121 of LEDs are illuminated.

It is contemplated that this particular arrangement of LEDs, together with the appropriately shaped LED source 95, could be used to produce a "spotlight effect" in which the spotlight could have a wider and wider beam as needed, depending on the number of LEDs (116, 118) illuminated. It is well within the scope of the present invention to provide any practical number of LEDs, and illuminate them in any practical number of ways. This is well within the skill of those in the lighting arts.

Thus, by carefully studying the problems present in the art, a novel housing for intelligent lights is provided, together with an intelligent light fixture and intelligent light system.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A lighting fixture comprising:

a housing having a bottom surface and an aperture in the bottom surface;

a light source enclosed within the housing that directs light out through the aperture;

a translucent globe enclosing a bottom side of the housing;

a diffuser aligned below the aperture and within the globe, the diffuser having a solid volume defined by top, bottom, and side portions, wherein the top portion presents a single input surface for collecting the light for output to a number of output surfaces on an outward perimeter of the side portion; and wherein the number of output surfaces define a number of recesses that re-direct the light laterally towards the globe.

2. The lighting fixture of claim 1 wherein the diffuser is positioned a distance below the bottom surface of the housing and wherein at least a portion of the recesses re-directs light into a portion of the globe extending across the distance.

3. The lighting fixture of claim 1 wherein an outer surface of the top portion is flat from one side surface to the other side surface.

4. The lighting fixture of claim 1 wherein an outer surface of the bottom portion is flat from one side surface to the other side surface.

5. The lighting fixture of claim 4 wherein at least a portion of the bottom portion forms an unlit area below the diffuser by preventing light from continuing to travel in the downward direction.

6. The lighting fixture of claim 1 wherein a cross-section of the diffuser is uniform throughout heightwise across a width defined from one side surface to a diametrically opposed side surface.

7. The lighting fixture of claim 1 wherein an outer surface area of the top portion is greater than an outer surface area of the bottom portion.

8. The lighting fixture of claim 1 wherein each of the laterally extending recesses is parallel to an adjacent laterally extending recess.

9. The lighting fixture of claim 1 wherein at least a portion of the recesses are prismatically shaped.

10. The lighting fixture of claim 1 wherein at least a portion of the recesses are angled.

11. The lighting fixture of claim 1 wherein the globe is a conically shaped enclosure having only one open end, the only open end being removably clipped to the housing.

12. The lighting fixture of claim 1 wherein the globe is tinted and the diffuser is clear.

13. The lighting fixture of claim 1 wherein the recesses are shaped to uniformly re-direct light towards an entire inner surface of the globe.

14. A lighting fixture comprising:

a housing having a bottom opening;

a light source enclosed with the housing to direct light out through the bottom opening;

a translucent globe enclosing a bottom side of the housing;

a diffuser aligned below the bottom opening and within the globe, the diffuser having a solid volume defined by top, bottom, and side portions;

wherein an outer perimeter of the side portion is shaped to re-direct the downwardly directed light outwardly towards the globe; and wherein the top and bottom portions are generally circular and the solid volume is at least equal to a volume defined by the following equation:

$$\pi r^2 h$$

wherein r equals a lesser one of the radii of the top or bottom portions and h equals a height of the side portion.

15. The lighting fixture of claim 14 wherein the shape of the diffuser includes the top portion having a larger surface area than the bottom portion and the side portions sloping inwardly from the top portion to the bottom portion.

16. The lighting fixture of claim 15 wherein an entire outer surface of the diffuser is flat.

17. The lighting fixture of claim 15 wherein the top and bottom portions are flat and the side portion includes a number of recesses.

18. The lighting fixture of claim 17 wherein an entire outer surface of the top and bottom portions are parallel.

19. The lighting fixture of claim 18 wherein the entire outer surface of the top and bottom portions are parallel to the bottom surface of the housing.

20. The lighting fixture of claim 14 wherein the diffuser is positioned a distance below the housing and wherein at least a portion of the diffuser re-directs light into a portion of the globe extending across the distance.

21. The lighting fixture of claim 20 wherein the diffuser is shaped to re-direct light towards an entire inner surface of the globe.

22. The lighting fixture of claim 21 wherein the globe extends from the housing and around the top, bottom, and side portions.

23. The lighting fixture of claim 14 wherein a diameter of the aperture is smaller than a diameter of the diffuser and a diameter of the globe is greater than the diameter of the diffuser.

24. The lighting fixture of claim 1 wherein the entire input surface is perpendicular to an axis of the aperture.

* * * * *